US011076693B2

(12) United States Patent
Yong

(10) Patent No.: US 11,076,693 B2
(45) Date of Patent: Aug. 3, 2021

(54) CUBE CABINET

(71) Applicant: Zhong Yong, Shanghai (CN)

(72) Inventor: Zhong Yong, Shanghai (CN)

( * ) Notice: Subject to any disclaimer, the term of this patent is extended or adjusted under 35 U.S.C. 154(b) by 0 days.

(21) Appl. No.: 16/694,993

(22) Filed: Nov. 25, 2019

(65) Prior Publication Data

US 2021/0153649 A1 May 27, 2021

(51) Int. Cl.
*A47B 87/02* (2006.01)
*A47B 49/00* (2006.01)

(52) U.S. Cl.
CPC ..... *A47B 87/0292* (2013.01); *A47B 49/00* (2013.01)

(58) Field of Classification Search
CPC ... A47B 87/0292; A47B 49/00; A47B 49/004; A47F 3/10
See application file for complete search history.

(56) References Cited

U.S. PATENT DOCUMENTS 241,123 A * 5/1881 Danner ..... A47B 49/004 312/249.2
1,431,420 A * 10/1922 Preziosi ..... A47B 49/00 312/271
1,749,686 A * 3/1930 Theodoreagazzi .. A47B 83/045 312/225
4,643,496 A * 2/1987 Dahl ..... G11B 23/0236 312/125
4,781,299 A * 11/1988 Oyama ..... A47B 49/00 211/144
5,145,245 A * 9/1992 Fierthaler ..... A47B 46/00 312/321.5
5,346,079 A * 9/1994 Price, Jr. ..... A47B 49/004 211/131.1
7,789,473 B2 * 9/2010 Loewen ..... A47B 81/068 312/283
2003/0034718 A1 * 2/2003 Swenson ..... A47B 49/00 312/326

(Continued)

*Primary Examiner* — Hanh V Tran
(74) *Attorney, Agent, or Firm* — Nwamu P.C.

(57) ABSTRACT

This disclosure relates to a cube rotating cabinet, which comprises: a base, the storage boxes, a rotating mechanism and a hinge. Each storage box is a six-sided cube, one side of which is open. The base of the structure does not move nor rotate. The first side of the base is in contact with the ground, and the second side is in contact with different layers of storage boxes; each layer has four storage boxes, and the opening side of two of the boxes are the same in each layer and are in the opposite direction of the other two. The opening direction between the boxes of the adjacent layers is 90 degrees apart; each layer there is a hinge connection between two adjacent boxes; a rotating mechanism is arranged between the boxes of the adjacent ones, so that the box rotates with the rotating mechanism as a rotating shaft, and the maximum rotation can be to a 180 degrees maximum; surface of the base which is in contact with the storage boxes is provided with four rotating mechanisms, so that the first layer of the box in contact with the surface of the base rotates with the rotating mechanism as a rotating shaft; each layer of the moving device drives the rotation of the box of the next layer and when the upper and lower two boxes are opened or closed, the rotation direction of adjacent layers is opposite.

15 Claims, 5 Drawing Sheets

(56) References Cited

U.S. PATENT DOCUMENTS

| | | | | |
|---|---|---|---|---|
| 2003/0038569 | A1* | 2/2003 | Caldwell, Jr. | A47B 63/06 312/285 |
| 2013/0105424 | A1* | 5/2013 | Lin | A47B 87/0207 211/85.8 |
| 2015/0108880 | A1* | 4/2015 | Chung | A47B 87/0292 312/108 |
| 2017/0341216 | A1* | 11/2017 | Lin | B25H 1/12 |

* cited by examiner

CUBE CABINET

BACKGROUND

The disclosure relates to a cube rotating; opening and closing multi-layer showcase. The disclosure implements relative rotation of the upper and lower layers through dynamic analysis and mechanical principles. The centre of the upper and lower layers is disengaged. The disclosure relates to the field of cabinets and display technology.

Cabinets in homes are used for storage and display. Cabinet may be opened by puffing a handle; display windows face a single direction, and space utilization rate is not high. When the display cabinet is opened; the adjacent upper and lower layers are displaced in opposite directions.

SUMMARY

Figure 1:
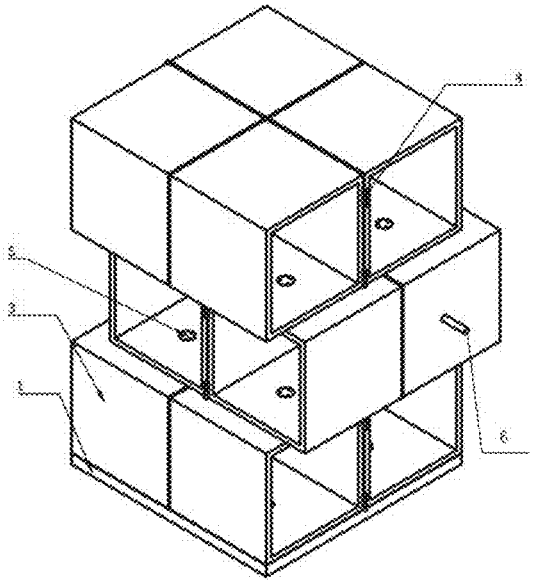
FIG. 1 is a schematic view showing the effect of the present disclosure when it is unfolded.

To address the above disadvantages, the present disclosure provides a novel cube rotating cabinet, which is stable in operation, labor-saving when opening, and has a good visual effect when opened and closed. This cube rotating cabinet is herein referred to as Rubik's™ cube rotating cabinet.

The cube rotating cabinet is characterized by: a multi-layer box and a rotating mechanism. Each box is a rectangular parallelepiped structure with one side open. There are 4 boxes in each layer. When the rotating cabinet is closed, the openings are opposite to each other, and the opening direction of the box in the adjacent two layers is shifted by 90 degrees. A rotating mechanism is disposed between the boxes of the adjacent two layers in each column, so that the box located above and below the rotating mechanism rotates in the opposite direction of the rotating shaft by the rotating mechanism, and the adjacent two layers are opened. The mouth also rotates in the opposite direction.

Preferably, each box can be rotated a maximum of 90 degrees. The rotation of 0 degree refers to the closed state of the rotating cabinet, and the opening of each layer of the box is opposite to each other; when the rotation is 90 degrees, the opening of each layer of the box is facing outward, and in the closed state, the opening is relatively arbitrary. When the two boxes are rotated 90 degrees in the opposite direction, the openings of the two are flush and oriented in the same direction on the outside.

Preferably, the first side edge and the second side edge of any one of the boxes are respectively provided with hinges, and the first side edge is a side close to the centre of the layer when the opening of the box is in the closed state. The second side is located on a side of the opening that is in contact with the other box, the second side is opposite the first side, and the second side is the box opening is rotated in the cube. When the cabinet is in the closed state, the outer side is exposed; the hinges of the first side and the second side are respectively connected to the two adjacent boxes of the same layer.

Preferably, the cube rotating cabinet further comprises a base, the first surface of the base is facing the ground, and the second surface is provided with four sliding rails, and the first layer of the box is placed thereon; The slide rail comprises a slide rail guide and a slide rail; The slide rail is a strip-shaped structure, one end of which faces the centre of the base and the other end faces the corner of the base; The slide rail is disposed inside the slide rail, and a rotating mechanism is slid thereon to connect the first layer of the box, so that the first layer of the box is rotated around the rotating mechanism and moves along the sliding rail along with the rotating mechanism.

Preferably, the first surface of the base is provided with a moving device to rotate the entire Rubik's cube rotating cabinet relative to the ground. Preferably, the box is in a cubic configuration. Preferably, each column of the rotating mechanism is disposed on the same straight line perpendicular to the ground. The four boxes of each layer are set to correspond to the four quadrants of the layer, and the top of each box is equally divided into four quadrants of a single box.

The rotation mechanism of each box in the first column is disposed in the third quadrant of the single box; the rotation mechanism of each box in the second column is disposed in the first quadrant of the single box, and the third column is in each box. The rotating mechanism is disposed in a first quadrant of a single box; and the rotating mechanism of each box in the fourth row is disposed in a fourth quadrant of a single box. Preferably, when the rotating cabinet is in the closed state, the handle is provided on the outer side surface of any one of the boxes, and the side surface provided with the handle is not provided with a hinge.

Preferably, for any two closed positions, the opposite opening of the box; the opening between the two is expanded from 0 degrees to 180 degrees, and the hinge provided on the first side is from the box. The centre of the hinge moves outwardly and is located on the exposed surface of the rotating cabinet when unfolded to 180 degrees; at the same time, the hinge disposed on the second side moves inward from the exposed surface of the rotating cabinet and is expanded to 180 degrees. The time is at the centre of this layer of box.

Preferably, for an open opposite box in any two closed states, when the opening between the two is 0 degrees, the four boxes of each layer are arranged in a rectangular shape, and the two adjacent boxes are arranged. The stacking is not dislocated in the horizontal direction; when the opening between the two is 90 degrees by rotation, the four boxes of each layer are arranged in a cross shape, and the boxes of the adjacent two layers are dislocated in the front and rear direction. When the opening between the two is 180 degrees by rotation, the four boxes of each layer are arranged in a rectangular shape, and the boxes of the adjacent two layers are misaligned in the front-rear direction and the left-right direction.

Among other advantages, the present disclosure has light material, the base and the upper layer box can be rotated in linkage, and when the upper and lower two-layer box are closed or closed, the rotation direction is opposite, and the position is changed or restored in the vertical and horizontal directions, and the cabinet is opened. When it is closed, the movement is smooth and the resistance is small.

DETAILED DESCRIPTION

The present disclosure will be further described in detail with reference to the accompanying drawings and specific embodiments of the present disclosure, which are not intended to limit the scope of the disclosure.

A Rubik's cube rotating cabinet as shown in FIG. 1 includes: a base (1), a box (3), a rotating mechanism (5), a hinge (4), a handle (6), and a box (3). The Rubik's cube rotating cabinet is a cubic structure (or a rectangular parallelepiped structure), one side of which is open.

Figure 2:
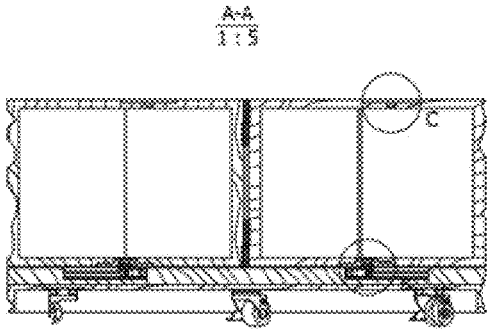
FIG. 2 is a schematic view showing the structure of the first layer box and the base.
Figure 3:
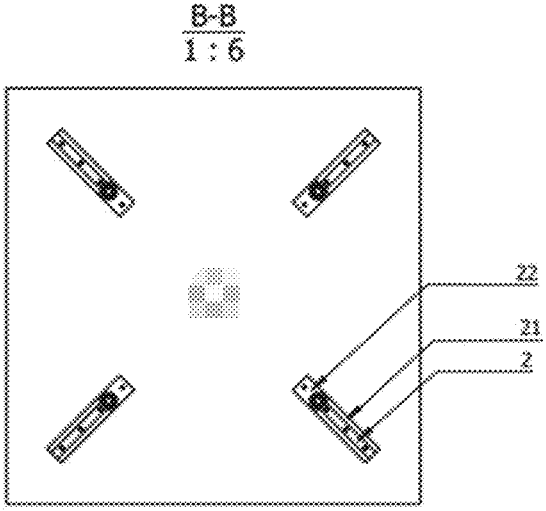
FIG. 3 is a schematic view of the base structure.

The structure of the base (1) is as shown in FIG. 2 and FIG. 3, the first side faces the ground, and the mobile device (pulley, etc.) is used on the ground. The third side of the base (1) is placed in a three-layer box (3), and each box has four boxes (3). When the Rubik's cube rotating cabinet is closed, the openings of each layer of the box (3) are oppositely arranged, and the opening directions of the adjacent two layers of the box (3) in the same column are different by 90 degrees.

Figure 4:
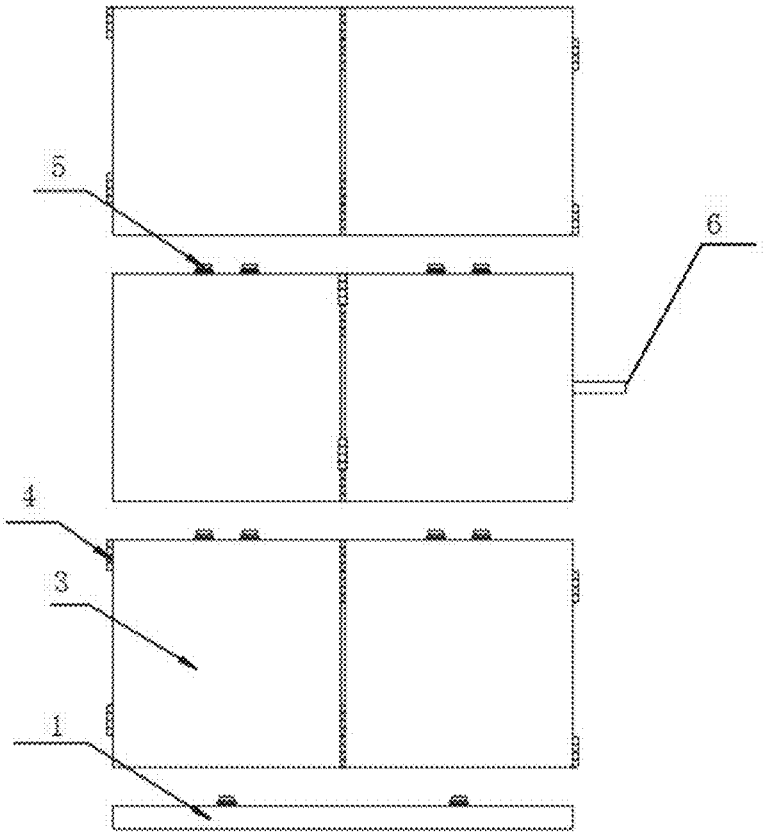
FIG. 4 is a schematic view showing the layered structure of the present disclosure.

As shown in FIG. 4, the two adjacent boxes (3) of each layer are connected by a hinge (4), so there are a total of 4 hinges (4); the first side of any one of the boxes and the second side are respectively provided with hinges, the first side is a side of the box opening close to the center of the layer when the Rubik's rotating cabinet is closed, and the second side is located next to the open one and the other side. The sides of the phase contact are combined, and the second side is opposite to the first side, and the second side is the side exposed to the outside when the box opening is closed.

A rotating mechanism (5) is disposed between the two adjacent boxes (3), so that the box (3) can be rotated by the rotating mechanism (5), and can be rotated by a maximum of 180 degrees; The rotating mechanisms are all arranged on the same straight line perpendicular to the ground; here, the four boxes (3) of each layer correspond to the four quadrants, and the top of each box (3) is equally divided into 4 quadrants. Then, the boxes of the ABCD column correspond to the first to fourth quadrants of each layer, respectively, the rotation mechanism (5) of each box in column A is set in the first quadrant of a single box. The rotating mechanism (5) of each box in the B column is disposed in a second quadrant of a single box, and the rotating mechanism (5) of each box in the C column is disposed in a third quadrant of a single box, and the rotating mechanism (5) of each box in row D set in the fourth quadrant of a single box.

When the rotating cabinet is in the closed state, the middle casing (3) is exposed on two of the outer sides, and a handle (6) is respectively arranged to facilitate the rotating box (3). These sides of the handle (6) are provided, and hinges (4) are not provided at the same time.

The second side of the base (1) is provided with four slide rails (2) on which a first layer of boxes (3) is placed; the slide rails (2) comprise slide rails (21) and slide rails (22); The slide rail (22) is a strip-shaped structure having one end facing the center of the base (1) and the other end facing the corner of the base (1); the slide rail (21) is disposed inside the slide rail (22), And the rotating mechanism (5) is slidably disposed thereon so that the first layer of the box (3) can be rotated about the rotating mechanism (5) and can move along the rail guide (21) with the rotating mechanism (5).

Figure 5:
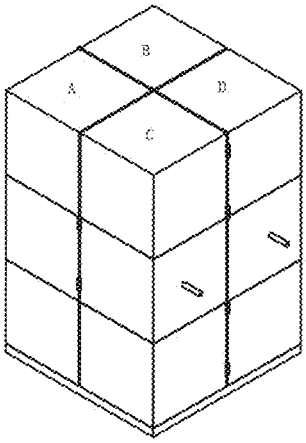
FIG. 5 is a schematic view showing the structure of the present disclosure when it is closed.

A first embodiment of the present disclosure is shown in FIG. 5, in which the upper, middle and lower three-layer boxes are used, and are constructed in four rows A, B, C, and D. For example, the rotation between the upper layer and the middle layer box is as follows. In the closed state of the Rubik's cube rotating cabinet, the upper box structure is the A-column box and the C-column box combined with the opening, the B-column box and the D box. The openings of the column boxes are oppositely arranged, and the box structure of the middle layer is opposite to the opening of the column of the row A and the row of the box of the column B, and the opening of the box of the column C and the row of the box of D.

The hinges of the upper row A and the C rows are close to the center, the hinges of the A row and the B row are exposed, and the hinges of the D and C columns are close to the center. The hinges of the D-column box and the B-column box are close to the center. Since the direction of the opening is staggered by 90 degrees, the sides of the upper and middle boxes of the hinges are staggered (FIG. 10), and the hinges of the middle row A and the C rows are exposed, and the row A is closed. The hinges connected to the B-column box are close to the center, the hinges of the D-column box and the C-column box are exposed, and the hinges of the D-column box and the B-column box are close to the center.

Figure 6:
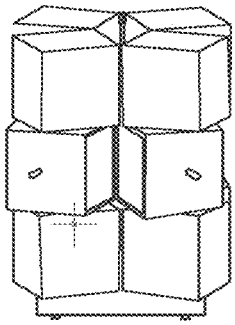
FIG. 6 is a schematic view showing the structure of the present disclosure when it is unfolded at 30 degrees.
Figure 7:
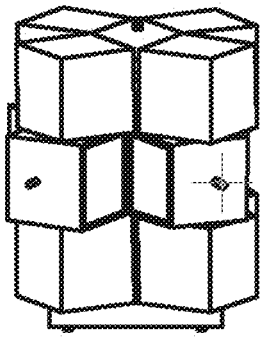
FIG. 7 is a schematic view showing the structure of the present disclosure at 90 degrees.
Figure 10:
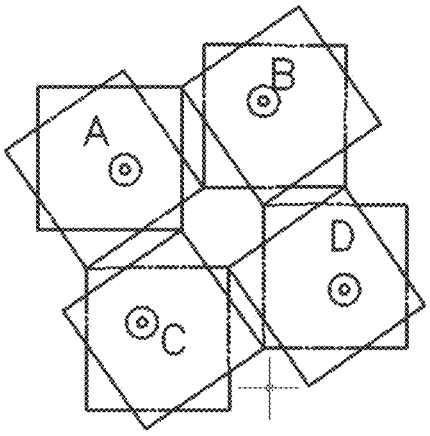
FIG. 10 is a plan view of the two-layer structure of the present disclosure when unfolded at 30 degrees.
Figure 11:
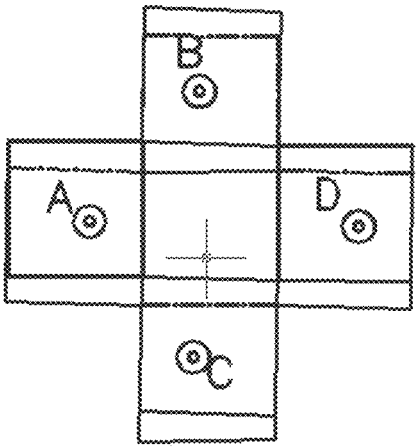
FIG. 11 is a plan view of the two-layer structure of the present disclosure when it is unfolded at 90 degrees.

As shown in FIGS. 6 to 7, when the C-column box of the rotating middle layer is combined with the D-column box, the angle between the openings is changed from 0 degrees to 180 degrees (FIG. 6 corresponds to 30 degrees of expansion, and it is overlooked). The effect is as shown in FIG. 10; FIG. 7 is expanded to 90 degrees, and the top view effect is as shown in FIG. 11), and the hinges of the A-column box and the B-column box are connected, and the C-column box and the D-column box are connected.

The hinges are moved from the inside to the outside, and the hinges of the A-column box and the C-column box are connected, and the hinges of the B-column box and the D-column box are moved from the outside to the inside; the upper part of each of the middle layers is connected. The rotating mechanism is arranged to drive the opposite row of the upper row of the upper layer to rotate in the opposite direction. In the process, the connection of the upper box and the row of the box of the column B are combined with the box of the column C and the box of the column D. The hinge moves from the outside to the inside, and the hinges that connect the A-column box and the C-column box are connected, and the hinges that connect the B-column box and the D-column box move from the inside to the outside. When the opening is unfolded by 90 degrees, the middle box and the upper box are in the same direction and have a cross shape. At this time, due to the misalignment of the rotating mechanism, there is a misalignment between the middle layer and the upper layer box.

Figure 8:
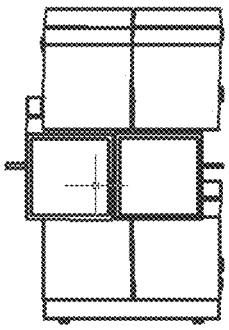
FIG. 8 is a schematic view showing the structure of the present disclosure when it is expanded by 180 degrees.
Figure 9:
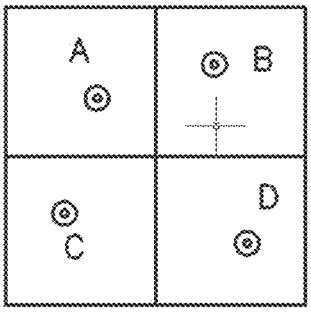
FIG. 9 is a plan view of the two-layer structure of the present disclosure when closed.
Figure 12:
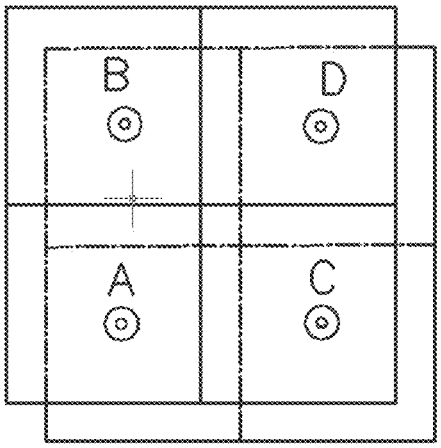
FIG. 12 is a plan view of the two-layer structure of the present disclosure when it is expanded by 180 degrees.

As shown in FIG. 8, when the C-column box of the rotating middle layer is combined with the D-column box and the angle between the openings is 180 degrees, the top view diagram is shown in FIG. 12. Here, the middle layer box and the upper layer box each constitute a rectangular structure, but due to the misalignment arrangement of the rotating mechanism, there is not only a misalignment between the middle layer and the upper layer box but also a misalignment in the left and right direction. And the opening of each layer of the box is facing outwards, which produces a desirable visual effect when opening and closing. When closed or at various angles of expansion, the opening and hinge arrangement and movement of the lower case are the same as those of the upper case.

The disclosure is not limited to the specific embodiments described above. The disclosure extends to any new feature or any new combination disclosed in this specification, as well as any novel method or process steps or any new combination disclosed. Although the content of the present disclosure has been described in detail by the above preferred examples, it should be understood that the above description should not be construed as limiting. Various modifications and alterations of the present disclosure will be apparent to those skilled in the art. Therefore, the scope of the disclosure should be determined by the appended claims.

The invention claimed is:

1. A cabinet comprising:

a multi-layer of boxes with a-rotating mechanisms, wherein each box is a rectangular parallelepiped structure with an opening, wherein said boxes are four in each layer, wherein when the cabinet is closed, the openings are opposite to each other, and the opening direction of each box in adjacent two layers in each column is shifted by 90 degrees, wherein the rotating mechanism is disposed between the boxes of the adjacent layers in each column, so that the box is located above and below the rotating mechanism, wherein when the rotating mechanism is rotated, a shaft rotates in the opposite direction and causes the openings of the adjacent two layers of boxes to rotate in opposite directions.

2. The cabinet of claim 1, wherein each box can be rotated by a maximum of 90 degrees.

3. The cabinet of claim 2 wherein a rotation of 0 degree is a closed state of the rotating cabinet.

4. The cabinet of claim 3 wherein any two of the opposite boxes are rotated by 90 degrees in the opposite direction, the openings of the two are flush and face the same direction on the outer side.

5. The cabinet of claim 2, wherein a first side and a second side of any one of the boxes are respectively provided with hinges, and the first side is a side of the box that is near a center of the layer when the cabinet is closed, the second side is located at a side of the opening that is in contact with an adjacent box, and the second side is opposite the first side, wherein the second side is faced outwards when a box opening is closed, wherein the hinges of the first side and the second side are respectively connected to two boxes adjacent to each other.

6. The cabinet of claim 1 further comprising a base having a first slide rail on which a first layer of boxes is placed.

7. The cabinet of claim 6 wherein the first slide rail comprises a second slide rail and a third slide rail.

8. The cabinet of claim 7 wherein the third slide rail is a strip-shaped structure with one end facing a center of the base and the other end facing a corner of the base.

9. The cabinet of claim 7 wherein the second slide rail is disposed inside the third slide rail and a rotating mechanism of said rotating mechanisms is arranged thereon to connect the first layer box to rotate around the rotating mechanism and move along the sliding rail with the rotating mechanism.

10. The cabinet of claim 6 wherein the first surface of the base is provided with a moving device for rotating the entire cabinet relative to the ground.

11. The cabinet of claim 1 wherein each box is a cubic configuration.

12. The cabinet of claim 1 wherein each of the columns of rotating mechanisms is disposed on a same straight line perpendicular to the ground, wherein the four boxes of each layer are set to correspond to the four quadrants of the layer, and the top of each box is equally divided into four quadrants of a single box; wherein the rotating mechanism of each box in the first column is disposed in the first quadrant of the single box; the rotating mechanism of each box in the second column is disposed in the second quadrant of the single box, the rotating mechanism of each box in the third column is disposed in the third quadrant of the single box, and the rotating mechanism of each box in the fourth column is disposed in the fourth quadrant of the single box.

13. The cabinet of claim 5 wherein a handle is provided on the exposed side of any one of the boxes when the rotating cabinet is closed.

14. The cabinet of claim 12 wherein the cabinet is a puzzle rotating cabinet, wherein for any two closed positions in which the openings are opposite, the openings between the two closed positions are extended from 0 degrees to 180 degrees, and the hinge disposed on the first side is from the center of the box and moves outward and is located on the exposed surface of the rotating cabinet when unfolded to 180 degrees.

15. The cabinet of claim 14 wherein for any box with opposite open positions in any two closed states, when the opening between the two closed states is 0 degrees, the four boxes of each layer are arranged in a rectangular shape.

* * * * *